United States Patent [19]

Matsumoto

[11] Patent Number: 4,927,090

[45] Date of Patent: May 22, 1990

[54] METHOD AND APPARATUS FOR DISCHARGING SPOOLS

[75] Inventor: Masao Matsumoto, Toyama, Japan

[73] Assignee: Yoshida Kogyo K.K., Tokyo, Japan

[21] Appl. No.: 198,049

[22] Filed: May 24, 1988

[30] Foreign Application Priority Data

May 30, 1987 [JP] Japan ..... 62-137486

[51] Int. Cl.[5] ..... B65H 19/22; B65H 19/30

[52] U.S. Cl. ..... 242/67.1 R; 242/81; 414/398; 414/399; 414/911

[58] Field of Search ..... 242/81, 67.1 R, 56 R, 242/79, 47, 82, 83; 414/391, 398, 399, 684, 911; 198/463.3

[56] References Cited

U.S. PATENT DOCUMENTS

| | | | |
|---|---|---|---|
| 1,605,281 | 11/1926 | Reece | 242/78 |
| 3,721,397 | 3/1973 | Hiroshi Hori et al. | 242/81 X |
| 3,861,615 | 1/1975 | Kinnicutt, Jr. | 242/79 X |
| 4,251,037 | 2/1981 | Puchovsky | 242/81 |
| 4,512,528 | 4/1985 | Kuhn | 242/56 R |
| 4,534,157 | 8/1985 | McGill et al. | 198/463.3 X |
| 4,629,138 | 12/1986 | Kubo | 242/56 R |
| 4,714,209 | 12/1987 | Allard | 242/78 |

FOREIGN PATENT DOCUMENTS

| | | | |
|---|---|---|---|
| 1141692 | 2/1983 | Canada | 242/79 |

*Primary Examiner*—John M. Jillions

*Attorney, Agent, or Firm*—Hill, Van Santen, Steadman & Simpson

[57] ABSTRACT

An automatic unloading or discharging of a spool from the winding portion of a reeling machine to a carrier car is disclosed, wherein the spool held on the winding portion is first removed from the winding head as horizontal belt conveyors are vertically moved to an elevated position, then horizontally fed by the belt conveyors onto support arms disposed above the carrier car, thereafter lowered by the support arms toward the carrier car, and finally placed onto the carrier car as the support arms are relatively moved away from one another.

8 Claims, 6 Drawing Sheets

METHOD AND APPARATUS FOR DISCHARGING SPOOLS

BACKGROUND OF THE INVENTION

1. Field of the Invention

This invention relates to a method and apparatus for unloading or discharging a spool from a reeling machine after a continuous tape of fabric, paper, synthetic resin film or the like sheet material is wound on the spool.

2. Description of the Prior Art

In the manufacture of tapes, a spool having turns of a continuous tape wound thereof is removed from the winding portion of a reeling machine and then placed onto a carrier car for strage or subsequent processing including packaging. Heretofore, such spool discharging operation has been performed manually by the operator and hence is low in efficiency. Since the spool having full turns of the tape is large in size and heavy in weight, the conventional manual spool discharging work is highly laborious.

SUMMARY OF THE INVENTION

With the foregoing difficulties in view, it is an object of the present invention to provide a method and apparatus for automatically discharging a spool from the winding portion of a reeling machine to a carrier car such as a platform car.

According to the present invention, there is provided improved method and apparatus for automatically unloading or discharging a spool from the winding portion of a reeling machine to a carrier car, wherein the spool held on the winding portion is first removed from the winding head as horizontal belt conveyors are vertically moved to an elevated position, then horizontally fed by the belt conveyors onto support arms disposed above the carrier car, thereafter lowered by the support arms toward the carrier car, and finally placed onto the carrier car as the support arms are relatively moved away from one another.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
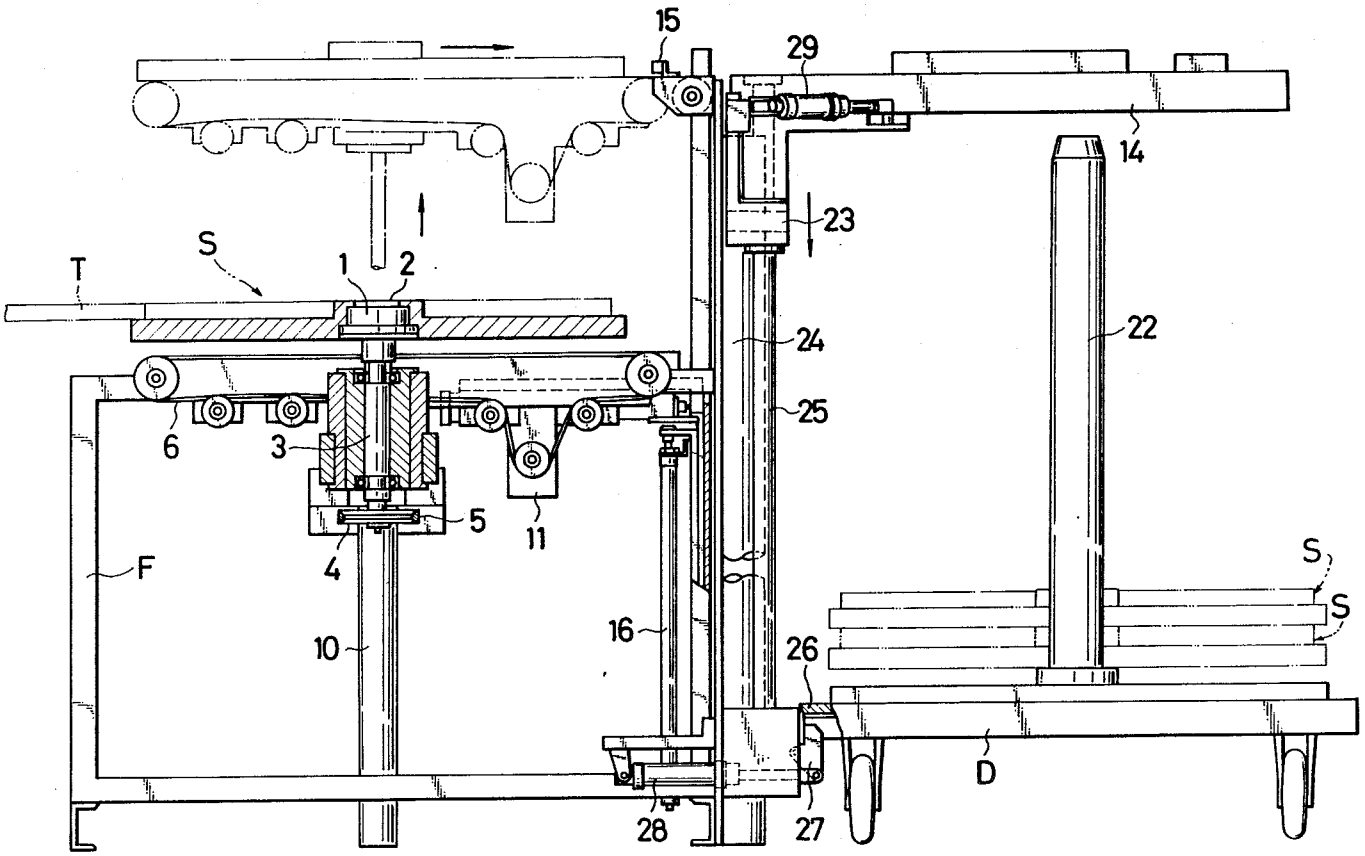
FIG. 1 is a front elevational view, partly in cross section, of a reeling machine having a spool discharging apparatus according to the present invention.
Figure 2:
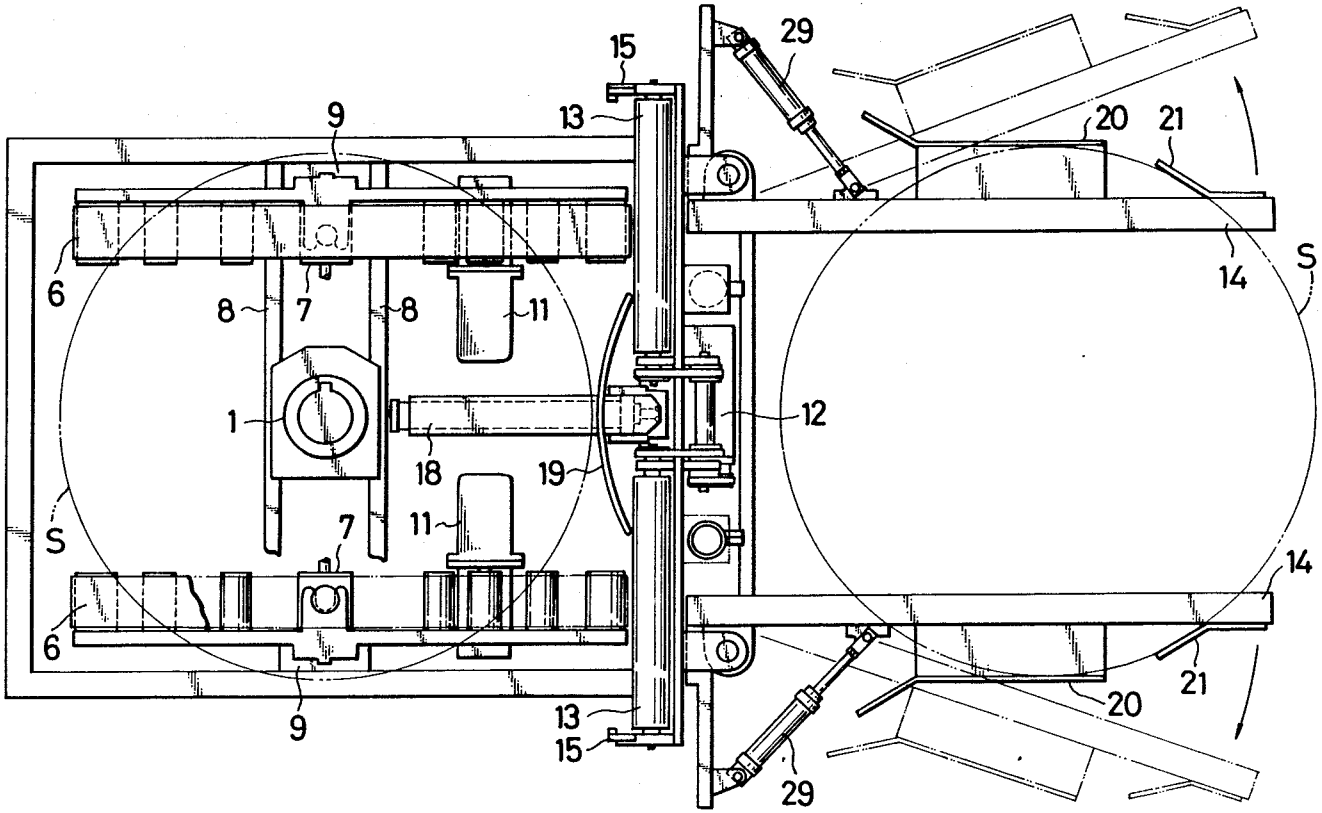
FIG. 2 is a plan view of FIG. 1, with parts cut away for clarity.

The principles of the present invention are particularly useful when embodied in a spool discharging apparatus incorporated in a reeling machine such as shown in FIGS. 1 and 2 for automatically removing a spool from a reeling or winding station of the machine and loading the spool onto a carrier car such as a platform car after a continuous tape of fabric, paper, synthetic resin film or the like sheet material is wound on the spool. In the illustrated embodiment, the tape to be wound on the spool S comprises a fastener tape T for hook-and-loop fasteners and the reeling machine constitutes the last part of a fastener-tape finishing or processing system including a heat-setting machine, a dyeing machine and a coating machines arranged in row.

The reeling machine has a winding portion or unit, and the spool discharging apparatus includes a spool conveyer unit and a spool loading unit.

The winding unit of the reeling machine includes a stepped circular winding head 1 disposed centrally over a frame F of the reeling machine for supporting thereon a spool S on which the fastener tape T is to be wound. The spool S has a central hole 2 complementary in contour to the shape of the stepped winding head 1. The winding head 1 is integrally formed with the upper end of a vertical shaft 3 rotatably mounted on the frame F. The lower end of the shaft 3 is connected with a pulley 4 coupled in driven relation to a motor (not shown) via an endless belt 5. With this construction, the shaft 3 is driven by the motor to rotate the winding head 1 and the spool S mounted thereon for winding the fastener tape T on the spool S.

Figure 7:
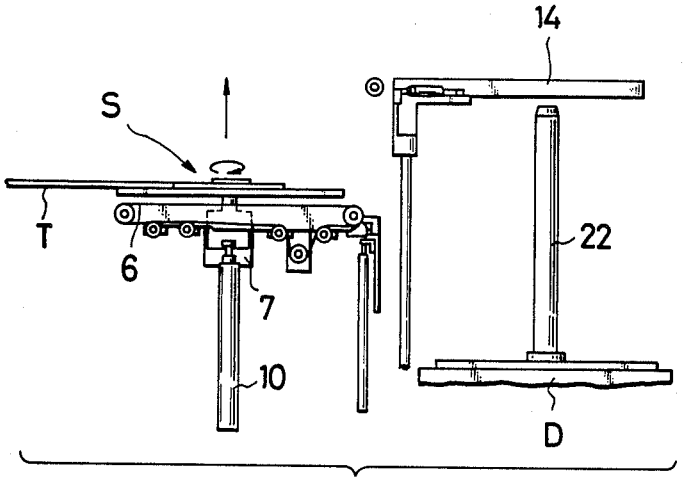
FIGS. 7 through 10 are diagrammatical views illustrative of a sequence of steps of operation of the spool discharging apparatus.
Figure 8:
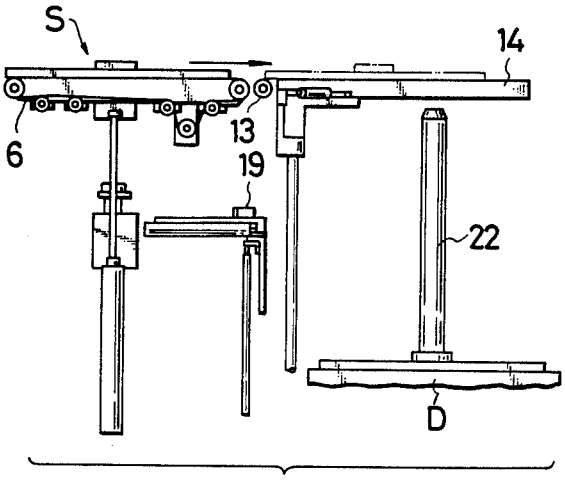
Figure 9:
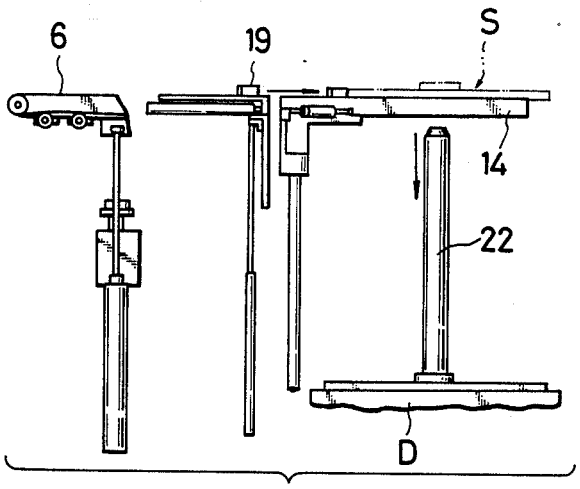

The spool conveyor unit of the spool discharging apparatus is so constructed as to lift the spool S on which a predetermined number of turns of the fastener tape T is wound, thereby removing the spool S from the winding head 1 and then to transfer the thus removed spool S horizontally to a discharge position above a parking lot in which a carrier car such as a platform car D is disposed (FIGS. 7–9). The spool conveyor unit, as shown in FIGS. 1 and 2, includes a pair of parallel belt conveyors 6, 6 extending in a horizontal plane below the winding head 1 and spaced equidistantly from the common central axis of the winding head 1 and the shaft 3. The belt conveyors 6, 6 are vertically movably supported on a pair of lifters 7, 7, respectively, secured to the frame F and have respective outer side portions slidably received in a pair of vertical guides 9, 9 disposed between and secured to a pair horizontal crossbars 8, 8 of the frame F. Each of the lifters 7 includes a fluid-pressure cylinder 10 having a piston rod connected at its outer end to the corresponding belt conveyor 6, so that the belt conveyors 6 are vertically reciprocable along the vertical guides 9 in response to operation of the cylinders 10. The belt conveyors 6 are normally held in the lower standby position indicated by solid lines in FIG. 1. When the cylinders 10 are operated to extend their piston rods, the conveyers 6 are moved upwardly from the solid-lined standby position beyond the winding head 1 until it reaches an elevated working position indicated by the phantom lines in the same figure. During this vertical upward movement, the conveyors 6 engages the underside of the spool S and then lifts up the same, thereby removing the spool S from the winding head 1. Then, the conveyors 6 are driven by motors 11, 11 associated respectively therewith to turn their endless belts in a direction to transfer the spool S rightwards in FIG. 1 toward the discharge position right above the platform car D.

A shown in FIG. 2, the spool transfer unit further includes a pair of aligned feed rollers 13, 13 disposed respectively adjacent to the forward ends (discharge ends) of the belt conveyors 6. The feed rollers 13 are commonly driven by a motor 12 in synchronism with the operation of the belt conveyors 6 so as to assist horizontal conveyance of the spool S performed by the belt conveyors 6 in a direction toward the discharge position. A pair of sensor elements 15, 15 such as a light projector and a photocell are disposed adjacent to the outer ends of the respective feed rollers 13 for detecting passage of the spool S through the feed rollers 13. When the trailing end of the spool S has moved past the feed rollers 13, the sensor elements 15 issue a command signal to control the operation of a pusher in a manner described below.

Figure 6:
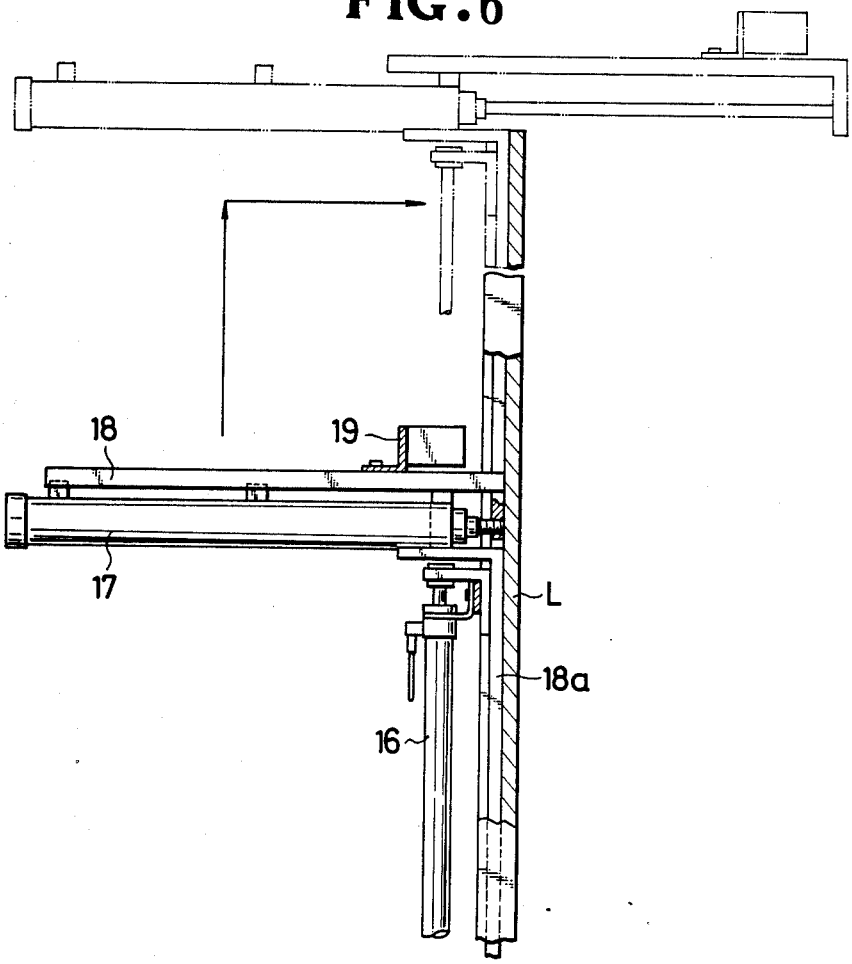
FIG. 6 is a front elevational view, partly in cross section, of the pusher.

The pusher includes a pusher plate 19 disposed between the belt conveyors 6 and normally held in a position adjacent to the forward ends of the belt conveyors 6 while the latter are rest at the lower standby position. The pusher plate 19 is curved to conform to the curvature of the peripheral wall of the spool S for stable feeding of the spool S. As shown in FIG. 6, the pusher plate 19 is secured to a horizontal arm of an inverted L-shaped support member 18, the vertical arm of the support member 18 being connected to a piston rod of a fluid-pressure cylinder 17 extening parallel to the horizontal arm. The cylinder 17 is supported by a bracket 18*a* slidably guided by a vertical column L of the frame F. The bracket 18*a* is connected to a piston rod of a fluid-pressure cylinder 16 vertically supported by the column L. Upon issuance of the command signal from the sensor elements 15 (FIG. 2), the cylinder 16 is actuated to extend its piston rod, thereby moving the bracket 18*a* (and also the cylinder 16, the support member 18 and the pusher plate 19) upwardly along the column L from a lower standby position indicated by the solid lines to an elevated working position indicated by the phantom lines in FIG. 6. Then, the cylinder 17 is actuated to extend its piston rod to thereby move the support member 18 and the pusher plate 19 horizontally rightwards in the same figure. Thus, the pusher plate 19 engages the trailing end of the spool S and then pushes the spool S into the discharge position in which the loading unit is normally disposed.

Figure 3:
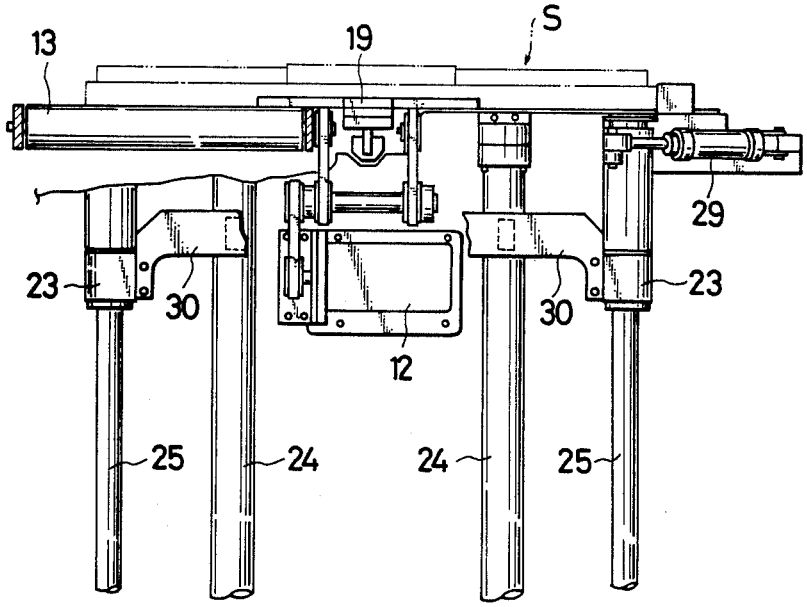
FIG. 3 is a side elevational view of a part of the reeling machine, showing a pusher of the spool discharging apparatus.
Figure 4:
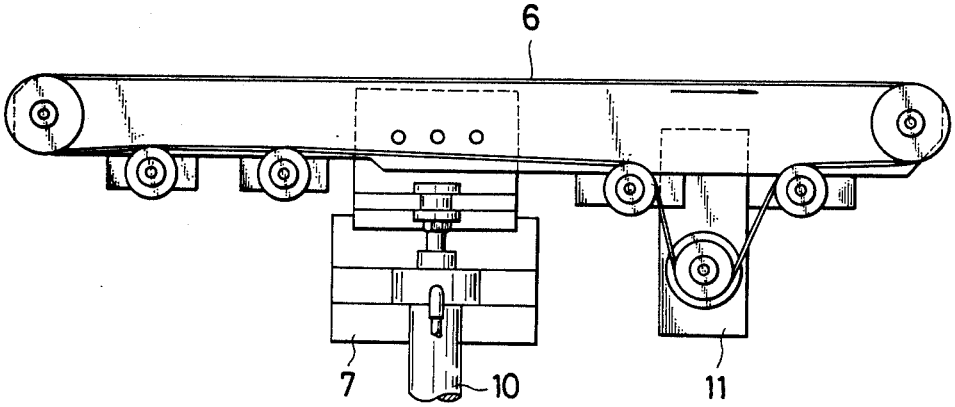
FIG. 4 is a front elevational view of a conveyor of the spool discharging apparatus.
Figure 5:
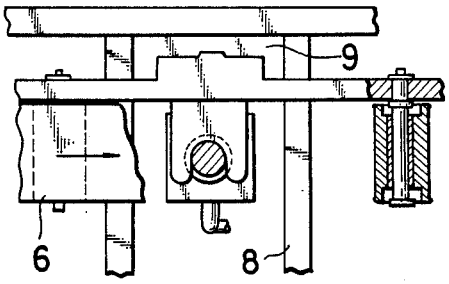
FIG. 5 is a plan view, partly in cross section, of a vertical guide portion for the conveyor.
Figure 10:
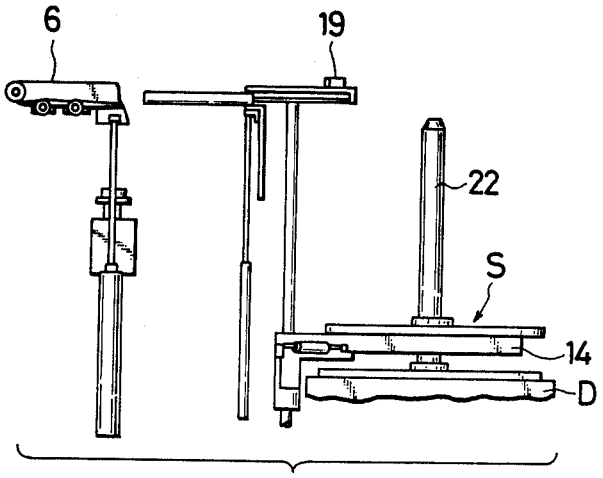

The loading unit includes, as shown in FIGS. 1 and 2, a pair of spaced support arms 14, 14 extending in the same horizontal plane as the belt conveyors 6 as the latter are disposed in the elevated working position (phantom lines in FIG. 1). The support arms 14 are connected at their proximal ends to a pair of sleeves 23, 23, respectively, slidably fitted over vertical guide rods 25 secured to the frame F. As shown in FIG. 3, the sleeves 23 are connected together by a horizontal connecting plate 30 which in turn is connected to piston rods of a pair of parallel spaced fluid-pressure cylinders 24, 24 vertically supported by the frame F. With this arrangement, in response to the operation of the cylinders 24, the sleeves 23 slide along the guide rods 25 to thereby vertically move the support arms 14 between the elevated spool-receiving position shown in FIG. 9 and the lower spool-releasing position shown in FIG. 10.

As shown in FIG. 2, the support arms 14 are connected respectively to piston rods of a pair of fluid-pressure cylinders 29 pivotably connected to the frame F. In response to the operation of the cylinders 29, the support arms 14 are pivotally moved toward and away from each other about the vertical guide rods 25 between a first position to carry the spool S and a second position to release the spool S therefrom onto the platform car D. The support arms 14 are normally held in the first position indicated by the solid lines and they are brought to the second position when they are lowered to the releasing position. Each of the support arms 14 includes an L-shaped guide plate 20 secured to an intermediate portion of the support arm 14 for guiding the peripheral wall of the spool S, and an arcuate stopper plate 21 secured to the distal end of the support arm 14 for limiting movement of the spool S past the stopper plate 21 when the spool S is advanced by the pusher plate 19 along the support arm 14. The stopper plates 21 are positioned such that when the spool S is held in abutment with the stopper plates 21, the central hole 2 of the spool S is disposed in registry with a vertical guide post 22 (FIG. 1) of the platform car D.

The spool discharging apparatus further includes locking hook 27 releasably engageable with an end portion 26 of the platform car D to hold the platform car D in position against displacement while the platform car D is standing in the parking lot defined beneath the support arms 14. The locking hook 27 is pivotably mounted on a lower end portion of the frame F and angularly moved by a fluid-pressure cylinder 28 pivotally conneted to the frame F. In response to the operation of the cylinder 28, the locking hook 27 angularly moved between a locking position to engage the carrier car D and a releasing position to unlock the carrier car D.

Operation of the spool discharging apparatus of the foregoing construction is described below with reference to FIGS. 7–10.

When the spool S is filled with turns of a fastener tape T wounded thereon as shown in FIG. 7, rotation of the winding head (not designated here) is stopped. Then the cylinders 10 are actuated to elevate the conveyors 6 to the position shown in FIG. 9, during that time the spool S is lifted up by the conveyors 6 and removed from the winding head. Upon arrival at the elevated position, the conveyors 6 are driven to feed the spool S rightwards onto the support arms 14 which are held parallel spaced relation to one another. Simultaneously with the driving of the conveyors 6, the feed rollers 13 are rotated to assist conveyance of the spool S from the conveyors 6 to the support arms 14. When the trailing end of the spool S moved past the feed rollers 13, the pusher plate 19 is elevated from the position of FIG. 8 to the position of FIG. 9. Subsequently, the pusher plate 19 is moved horizontally rightwardly to force the spool S to slide along the support arms 14 until engagement of the spool S with the stopper plates 21 (FIG. 2) in which instance the central hole 2 (FIG. 1) in the spool S is in registry with the guide post 22 of the platform car D. Then the support arms 14 are lowered from the position of FIG. 9 to the position of FIG. 10 during which time the spool S is threaded over the guide post 22. The support arms 14 are pivotally moved laterally away from one another to thereby release the spool S to fall onto the platform car D.

Thereafter, the support arms 14 are elevated to the initial position shown in FIG. 9 and then moved toward each other. The pusher plate 19 is retracted to the position of FIG. 9 and then lowered to the position of FIG. 8. At the same time, the belt conveyors 6 are lowered to the position of FIG. 7. Thus, the respestive components of the discharging apparatus are ready for unloading of the next spool S. The foregoing sequence of operation is performed automatically under the control of the sensor elements 15 and limit switches, not shown.

Obviously, various modifications and variations of the present invention are possible in the light of the above teaching. It is therefore to be understood that within the scope of the appended claims the invention may be practiced otherwise than as specifically described.

What is claimed is:

1. An apparatus for discharging a spool from a reeling machine to a carrier car, the spool being disposed on a winding head of the reeling machine rotatable about a vertical axis, said apparatus comprising:

(a) at least one belt conveyor extending in a horizontal plane below the winding head and vertically movable to an elevated position above the winding head for lifting up the spool to remove the same from the winding head;

(b) at least one horizontal support arm extending in alignment with said conveyor for receiving therefrom the spool when said belt conveyor is disposed at said elevated position; and (c) means defining a parking lot disposed beneath said support arm for admitting the carrier car.

2. An apparatus according to claim 1, the number of said belt conveyor being two, said two belt conveyors being disposed on opposite sides of the winding head.

3. An apparatus according to claim 2, said two belt conveyors being spaced equidistantly from the vertical axis.

4. An apparatus according to claim 1, further including a horizontal feed roller disposed between the support arm and a discharge end of said belt conveyor when said belt conveyor is disposed at said elevated position, for assisting conveyance of the spool from said conveyor to said support arm.

5. An apparatus according to claim 1, the number of said support arm being two, said two support arms being movable toward and away from one another to releasably holding thereon the spool.

6. An apparatus according to claim 5, said support arms being pivoted at their one ends.

7. An apparatus according to claim 1, further including a pusher plate disposed upstream of said support arm and movable vertically and horizontally to force the spool to slide along said support arm.

8. An apparatus according to claim 7, said support arm having a stopper engageable with the spool to limit sliding movement of the spool.

* * * * *